United States Patent [19]

O'Sullivan et al.

[11] Patent Number: 4,522,157

[45] Date of Patent: Jun. 11, 1985

[54] CONVECTION SECTION ASSEMBLY FOR PROCESS HEATERS

[75] Inventors: Thomas F. O'Sullivan, Montclair, N.J.; Thomas W. Gronauer, Briarcliff Manor, N.Y.

[73] Assignee: Lummus Crest Inc., Bloomfield, N.J.

[21] Appl. No.: 581,818

[22] Filed: Feb. 21, 1984

Related U.S. Application Data

[63] Continuation of Ser. No. 431,901, Sep. 30, 1982, abandoned, which is a continuation-in-part of Ser. No. 221,801, Dec. 31, 1980, abandoned.

[51] Int. Cl.[3] ..... F22B 37/24; F28F 9/00

[52] U.S. Cl. ..... 122/510; 122/367 R; 122/512; 165/67; 165/76

[58] Field of Search ..... 165/149, 150; 122/235 A, 235 B, 235 D, 235 K, 235 J, 235 V, 367 R, 406 S, 421, 510, 512

[56] References Cited

U.S. PATENT DOCUMENTS

| | | | |
|---|---|---|---|
| 1,813,405 | 7/1931 | Kerr | 122/421 |
| 1,919,192 | 7/1933 | Behr | 122/421 |
| 2,267,314 | 12/1944 | Stikeleather | 165/149 |
| 2,372,675 | 4/1945 | Keenan, Jr. et al. | 165/67 |
| 2,437,452 | 3/1948 | Mckbaird | 165/150 |
| 3,174,301 | 3/1965 | Thorton et al. | 165/67 |
| 3,266,467 | 8/1966 | Winship | 122/510 |
| 3,267,914 | 8/1966 | Connell | 122/510 |
| 3,608,528 | 9/1971 | Mieth | 122/510 |
| 3,929,189 | 12/1975 | Lecon | 122/510 |
| 4,008,691 | 2/1977 | Kreider et al. | 122/510 |
| 4,079,702 | 3/1978 | Furukawa et al. | 122/510 |
| 4,096,909 | 6/1978 | Jukkola | 165/76 |
| 4,230,177 | 10/1980 | Berkestad | 165/67 |
| 4,246,872 | 1/1981 | Skinner et al. | 122/512 |

*Primary Examiner*—Henry C. Yuen

*Attorney, Agent, or Firm*—James N. Blauvelt

[57] ABSTRACT

An improved convection section assembly for process heaters comprising a plurality of horizontally-disposed heat transfer segments disposed in vertical array and supported by means attached externally to said assembly, said segments further comprising a plurality of tube sheets also supported by fixed external means. The use of such external support means enables the convection section assembly to be of unlimited width—which thereby permits the substitution of a large number of parallel heating coils for the conventional serpentine heating coil customarily used—and also enables the plurality of tube sheets to expand laterally. Thus, with only external refractory lined supports, there is no practical limit on the flue gas temperature that can be used.

15 Claims, 8 Drawing Figures

CONVECTION SECTION ASSEMBLY FOR PROCESS HEATERS

CROSS-REFERENCE TO OTHER APPLICATIONS

This is a continuation of application Ser. No. 431,901 filed Sept. 30, 1982, abandoned, which is a continuation in part of Ser. No. 221,801, filed Dec. 31, 1980, abandoned.

BACKGROUND OF THE INVENTION

1. Field of the Invention

This invention relates to heaters, and, more particularly, to a novel convection section assembly for heaters, and especially fluid process heaters.

2. Description of the Prior Art

Convection zones are normally used in direct-fired process heaters to obtain low temperature differentials between the process fluid inlet and flue gas exit. Extended surface tubes, i.e. tubes with fins or studs formed about or in their outer surface, are normally used in such convection zones, since the heat transfer coefficient on the outside (flue gas side) of the tubes is normally much lower than on the process side (inside) of the tubes.

The tubes are normally disposed longitudinally in the convection sections and are supported near the ends and at intermediate points by tube sheets (plates or castings having openings large enough to pass the tubes and attendant extended surface). Such an arrangement, however, limits the minimum spacing of the tubes to that which will leave sufficient material between the openings to permit sound construction and does not permit close placement of tubes to obtain high velocity and good heat transfer coefficient on the flue gas side. A variety of different devices have been proposed for tube supports, but these are all internal devices and therefore limit the flue gas temperature to levels that can be met by available metallurgy. The above deficiencies are illustrated by the following U.S. patents.

In U.S. Pat. No. 3,274,978, for example, to Palchik et al, having a common assignee with the assignee of the present invention, there is disclosed, in one embodiment, a vertical tube-type process heater having a single convection zone disposed above a plurality of radiant heating zones and provided with one or more sections of horizontally-disposed conduits. Furthermore, in U.S. Pat. No. 1,919,192 there is described a serpentine heating coil for which intermediate and end supports are needed. Consequently, in accordance with this arrangement, all such supports have to be internal, a factor which thereby limits the width of the convection section. In U.S. Pat. No. 3,929,189, moreover, the use of a vibration dampening device is described which clamps tightly against the tubes. In this patent, the supports for both the tubes and the dampening device as well are internal, thereby effectively limiting the width and flue gas temperature of the convection section.

In another patent, U.S. Pat. No. 4,246,872, another variety of tube support is described. In this patent, a structure is disclosed which accommodates differential expansion over the tubes by allowing the internal tube supports to swing or move, such supports being located in the flue gas stream.

However, in the design of both the prior art convection section assemblies for process heaters and of the tube supports utilized therein, there are no means provided to enable such convection assemblies to be of unlimited width and no means provided to accommodate unlimited flue gas temperature.

In addition, there are other considerations. For example, in accordance with the principles of normal construction, the width of the convection section is usually restricted to the limits of sound castings and construction. When the volume of fluid flow on the process side is large, either a large number of streams or large tubes must be used. Double or multiple serpentine coils may be used; however, this results in some tubes and return bends being inaccessible for repair or maintenance, difficulty in connecting to inlet and outlet manifolds, and some cross-flow effect which reduces over-all heat transfer effectiveness. It should also be noted that, when the tube diameter is doubled, only one-half the number of tubes may be installed in the same width. Moreover, the flow area of each tube is four times as large; therefore the flow area is doubled. Thus, the use of larger diameter tubes is not a satisfactory solution since such tubes have lower heat transfer coefficients for the same flow conditions, thereby requiring more surface area. Also, since the volume-to-surface ratio increases directly with tube diameter, and since some process services are sensitive to residence time, these factors would also be adversely affected by the use of large diameter tubes.

Thus, the known convection section assemblies are all characterized by the above significant deficiencies. The present invention now provides the means for overcoming such deficiencies; it provides a convection section assembly having only external fixed support means which in and of themselves can be of unlimited length, thereby: (a) permitting the convection assembly itself to be of unlimited width; (b) enabling the tube sheets supporting the tubes of the convection assembly to expand in a lateral direction; and (c) enabling the tube supports to be fixed and the tubes themselves to slide. Thus, with only such external fixed support means, which can be refractory lined, there is no practical limit on the flue gas temperature.

SUMMARY OF THE PRESENT INVENTION

The present invention thus is directed to a novel convection section assembly for a heater, which assembly has only external fixed support means and comprises a plurality of horizontally-disposed heat transfer segments disposed in vertical array. Such heat transfer segments further comprise a plurality of parallelly- and vertically-disposed paired tube sheets, also supported by fixed external means comprising respective parallel and horizontally-disposed paired beam support members mounted to vertically-disposed end column support members. Each of the vertically-disposed paired tube sheets is formed with slots disposed, sized, and located to receive a return bend, but not the extended surfaces of the tubes, whereby the tubes of each heat transfer segment extend laterally in the convection section.

BRIEF DESCRIPTION OF THE DRAWINGS

Understanding of the present invention will be facilitated by reference to the following detailed description, taken with the accompanying drawings, FIGS. 1–8, in which.

DETAILED DESCRIPTION OF THE DRAWINGS

Figure 1:
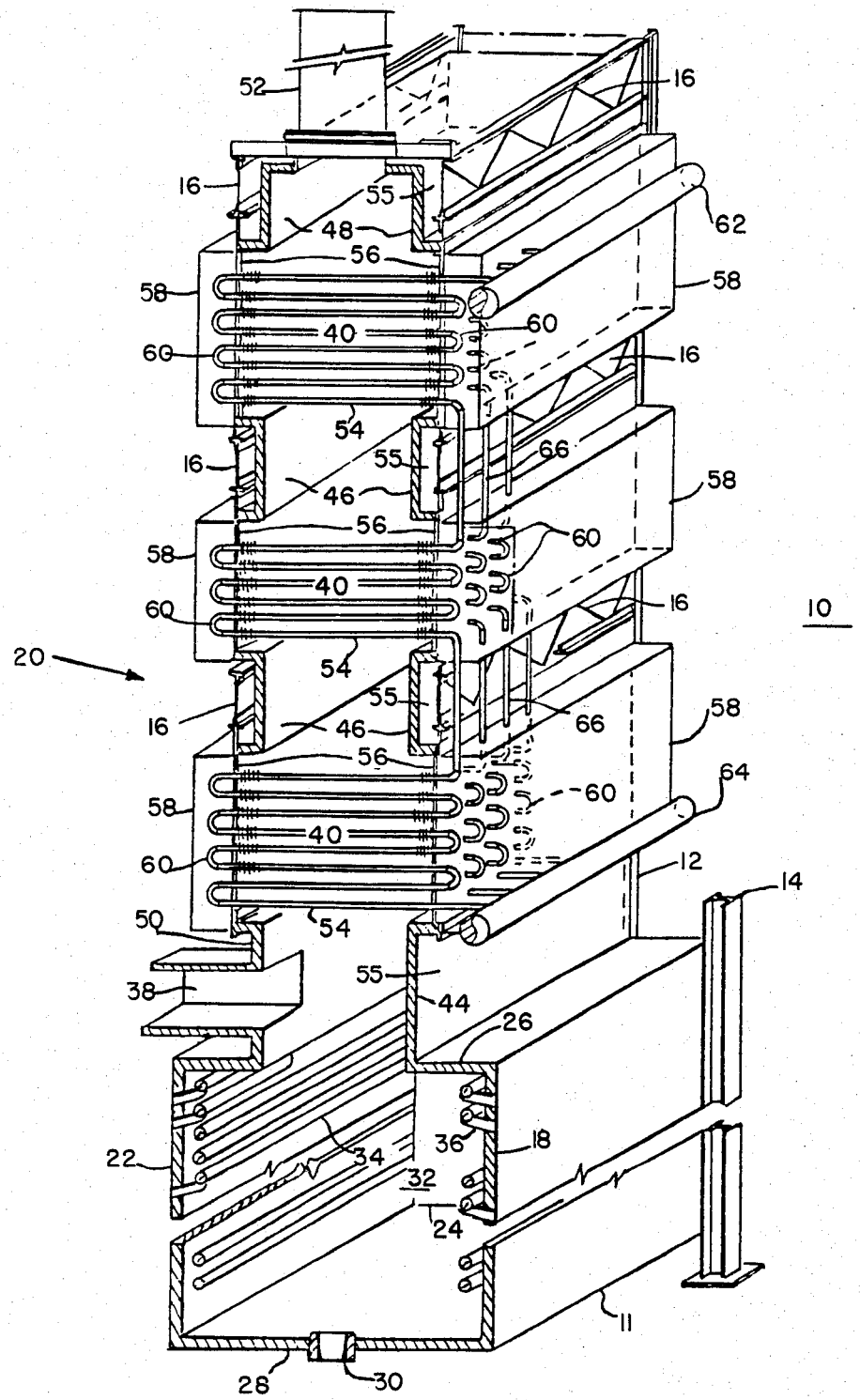
FIG. 1 is an isometric view, partially in section, of a process heater including the novel convection section assembly of the present invention.

The process heater, including the novel convection section assembly thereof, of the present invention may be utilized for a variety of applications, including the heating of hydrogen- and carbon monoxide-containing reducing gas and other synthesis gases where low pressure drop through the process coil or low residence time are important. The present process heater can also be used for the heating of air, steam, and other gases, particularly at low pressures, where their volume is large. It is understood that certain equipment, such as burners, manifold assemblies, valves, indicators, and the like have been omitted from the drawings to facilitate the description hereof, and that the placing of such equipment at appropriate places is deemed to be within the scope of one skilled in the art.

In a preferred embodiment, the present invention provides a convection section assembly for a heater which comprises:

a plurality of vertically disposed support members; a flue means; at least two heat transfer segments mounted in vertical array, each segment comprising: a pair of horizontally disposed beam support members mounted to said vertically disposed support members and located outside said flue means, the length of said members being a dimension of choice; a plurality of parallel and vertically disposed tube sheet members mounted to said beam support members and having orifices; wall means for enclosing ends of said tube sheet members; a plurality of horizontally disposed tube means including return bends for passage of a process fluid therethrough positioned within the orifices of said tube sheet members, said tube sheet members requiring no additional support means intermediate their extremities; inlet conduit means for introducing a process fluid to be heated into said tube means of said heat transfer segments; and outlet conduit means for withdrawing the heated process fluid from said tube means of said heat transfer segments.

In another preferred embodiment, the present invention also provides a heater assembly for process fluids, which comprises:

a first plurality of vertically-disposed support members; said and end walls enclosed by top and bottom walls mounted to said vertically-disposed support members and defining a heating zone having reactant tube means; burner means for heating said reactant tube means; inlet conduit means for introducing a process fluid to be heated into said reactant tube means; outlet conduit means for withdrawing a reactant gas from said reactant tube members;

a second plurality of vertically disposed support members; a flue means; at least two heat transfer segments mounted in vertical array, each segment comprising: a pair of horizontally disposed beam support members mounted to said second plurality of support members and located outside said flue means, the length of said members being a dimension of choice; a plurality of parallel and vertically disposed tube sheet members mounted to said beam support members and having orifices; wall means for enclosing ends of said tube sheet members; a plurality of horizontally disposed tube means including return bends for passage of a process fluid therethrough positioned within the orifices of said tube sheet members, said tube sheet members requiring no additional support means intermediate their extremities; inlet conduit means for introducing a process fluid to be heated into said tube means of said heat transfer segments; and outlet conduit means for withdrawing the heated process fluid from said tube means of said heat transfer segments.

Figure 2:
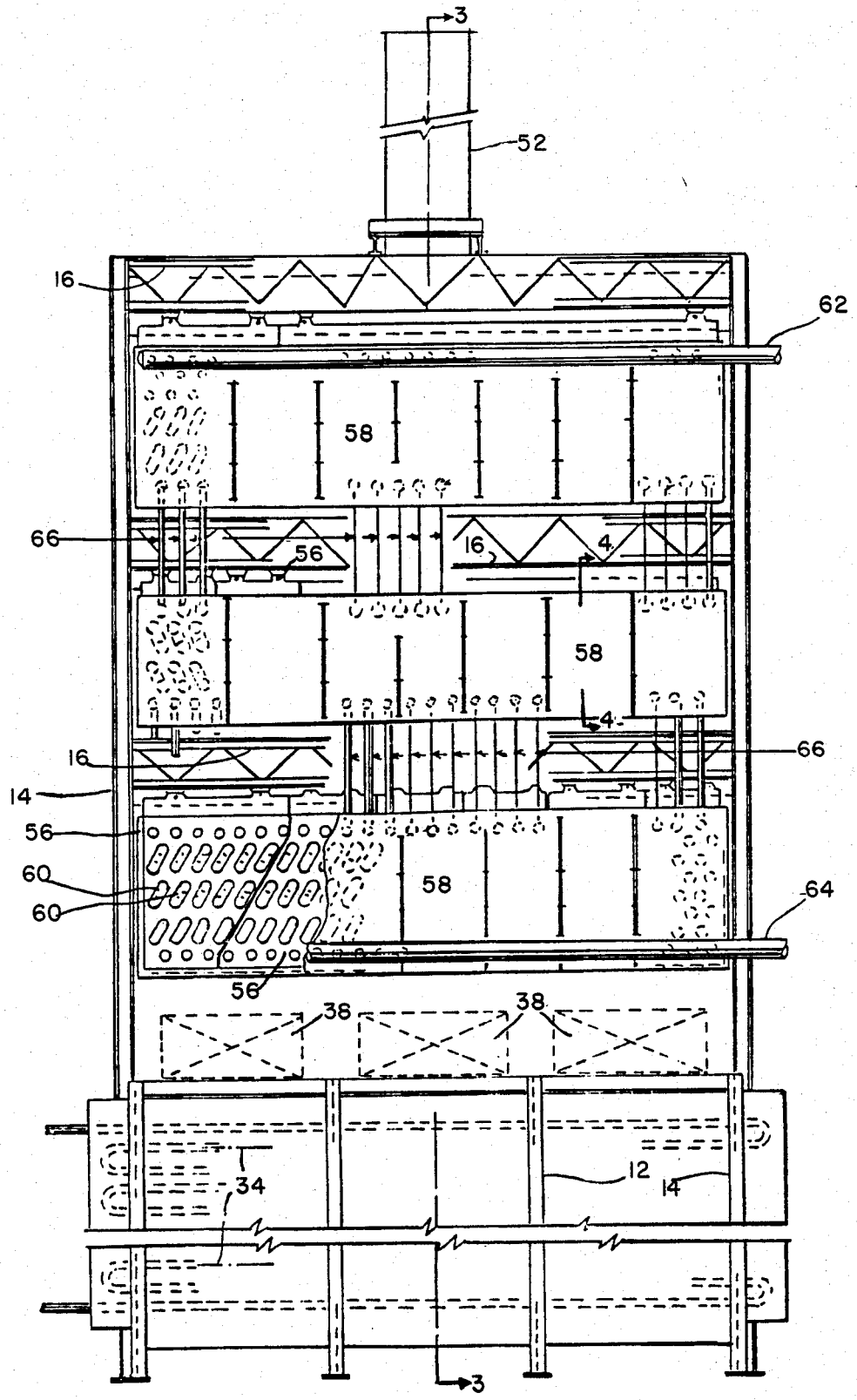
FIG. 2 is an elevational view of the process heater of FIG. 1.
Figure 3:
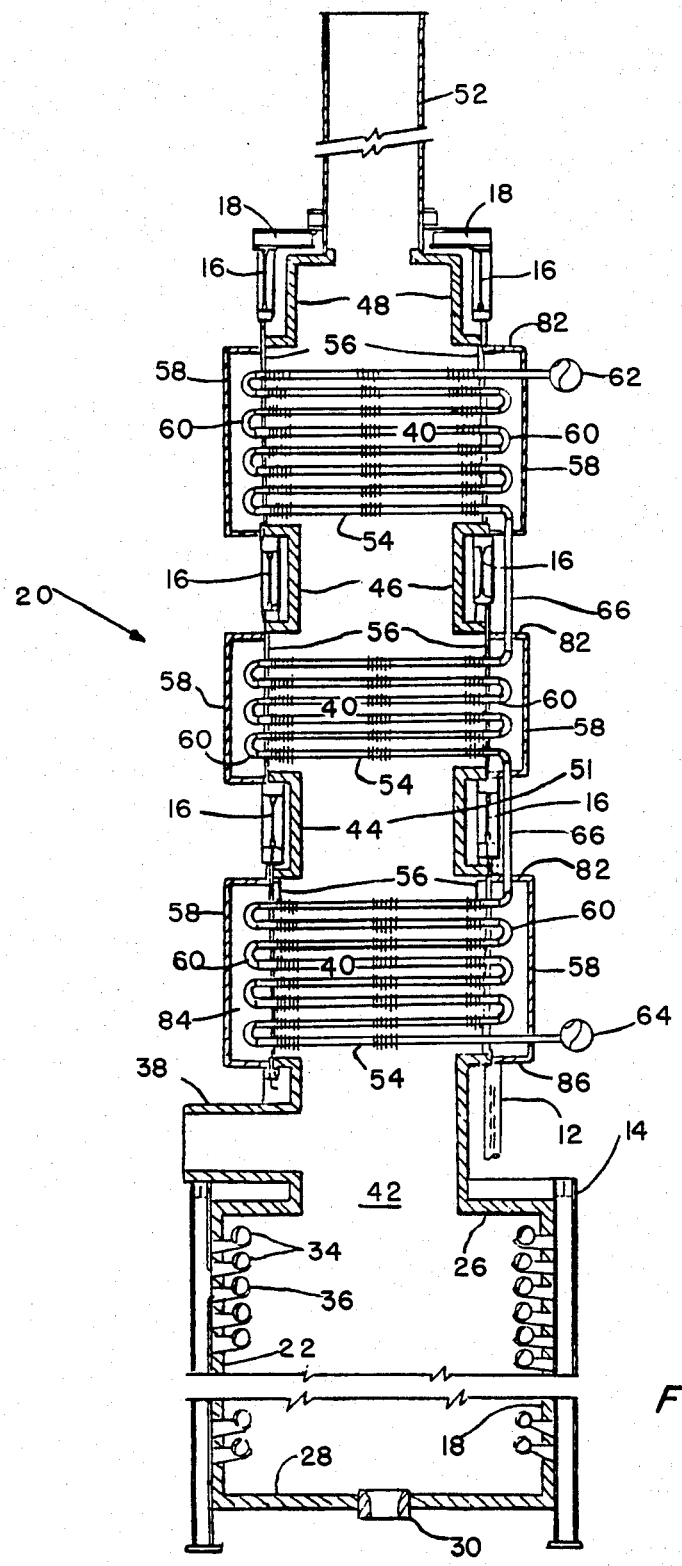
FIG. 3 is a cross-sectional view taken along the lines 3—3 of FIG. 2.
Figure 4:
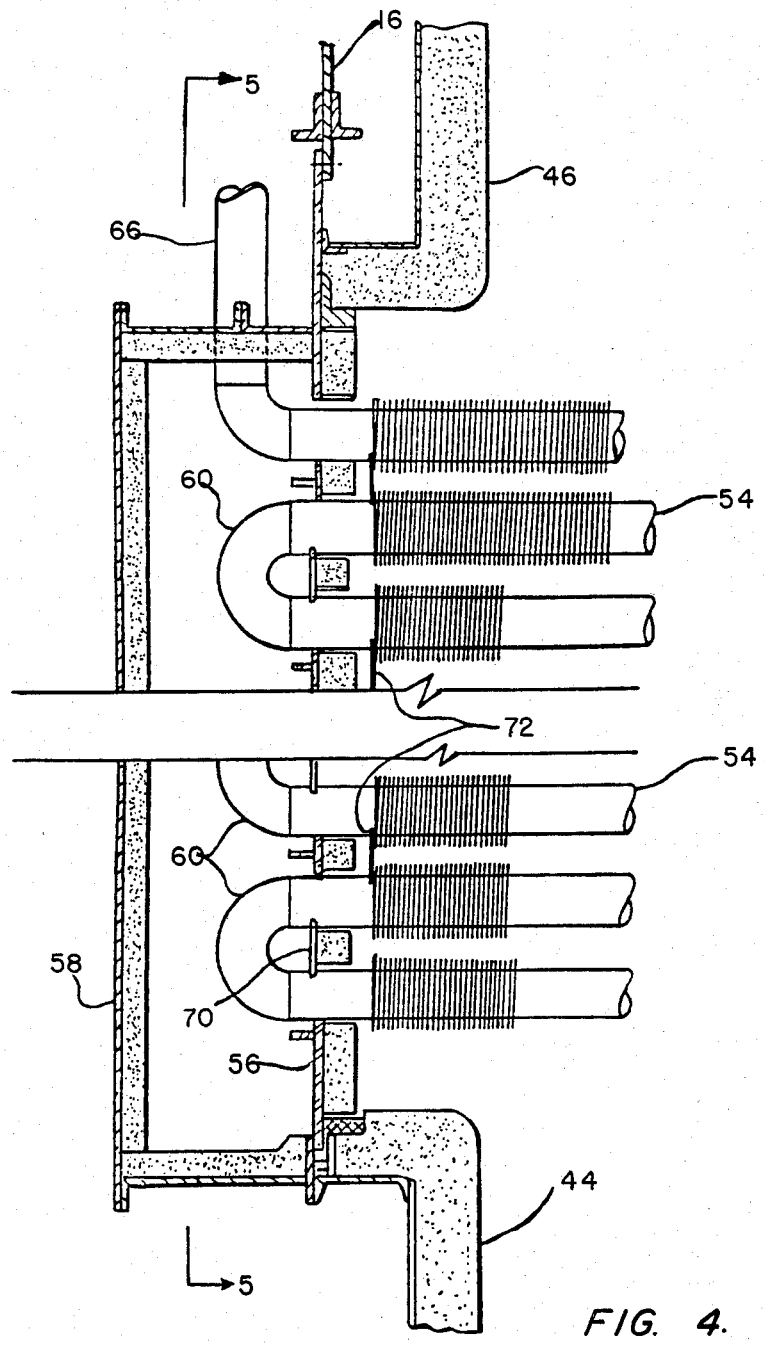
FIG. 4 is an enlarged side view of a heat transfer segment taken along the lines 4—4 of FIG. 2.

Referring now to the drawings and particularly to FIGS. 1 to 3, there is illustrated a horizontal tube-type heater assembly, generally indicated as 10, supported on a structural steel framework composed of vertically-disposed inner and outer column members 12 and 14, respectively, mounted on concrete piers and including a plurality of parallelly- and horizontally-disposed paired beam support members 16 mounted outside the flue of said heater assembly to the inner vertically-disposed column members 12.

The heater assembly 10 is composed of a furnace section 11 and a convection section assembly, generally indicated as 20. The furnace section 11 comprises elongated side walls 18 and 22, end walls 24 (one illustrated), top wall portions 26 and a floor 28 including floor burners 30, defining a radiant zone, generally indicated as 32. In the radiant zone 32, there is provided a plurality of rows or horizontally-disposed tubes 34 suitably positioned by supports 36 mounted to side walls 18 and 22. The furnace section 11 is provided with a flue gas conduit, generally indicated as 42 (FIG. 3) in flue gas communication with the convection section assembly 20. In an alternative embodiment, the radiant zone 32 may have no tubes at all and be used only for the combustion of fuels.

In another alternative embodiment, hot flue gases from other furnaces or heaters can be introduced by duct 38; but such additional flue gases need not be used. If desired, flue gas may also be introduced between heat transfer segments of the convection section assembly.

The convection section assembly 20 is composed of a plurality of horizontally-disposed elongated heat transfer segments, generally indicated as 40, in vertical array, and is supported by inner column members 12 to which the paired beam support members 16 are attached. The heat transfer segments 40 are separated by longitudinally extending lower, intermediate, and upper side wall sections 44, 46, and 48, respectively, (FIG. 1) including end wall assemblies 51 (FIG. 3), generally defining a vertically-disposed and longitudinally extending heat recovery convection section 20 through which the flue gases from the heater section 11 are passed to effect heat recovery.

The convection section assembly 20 is in flue gas communication with a stack 52, which provides a natural draft. Alternatively, any conventional mechanical means (not shown) such as a fan, for example, could also be used to provide or induce a draft, and the selection and placement of such means would be within the skill of the art to make. Each of the heat transfer segments 40 comprises tubes 54, interconnecting flue ducts 55, tube sheets 56, header boxes 58 housing tube sheet assemblies of such tubes 54, fixed support members 16 for the tube sheets 56, and also side walls (not shown). The tubes 54 are arranged in series flow by return bends 60 but in parallel flow between inlet manifold 62 and outlet manifold 64. The conduits 66 provide fluid communication between each parallel stream in each heat transfer section.

The tube sheet assemblies 56 and the header boxes 58 are mounted to respective paired external beam support members 16 by suitable means, such as nut and bolt assemblies, for positioning a plurality of horizontally-disposed tubes 54, preferably of the extended surface type in fluid communication by return bends 60. In this configuration, lateral expansion of the plurality of tube sheets 56 is accommodated by expansion space 57 adjacent the tube sheets. The external support members thereof being fixed, the expansion of the tubes themselves is accommodated by the tubes being allowed to slide.

Figure 5:
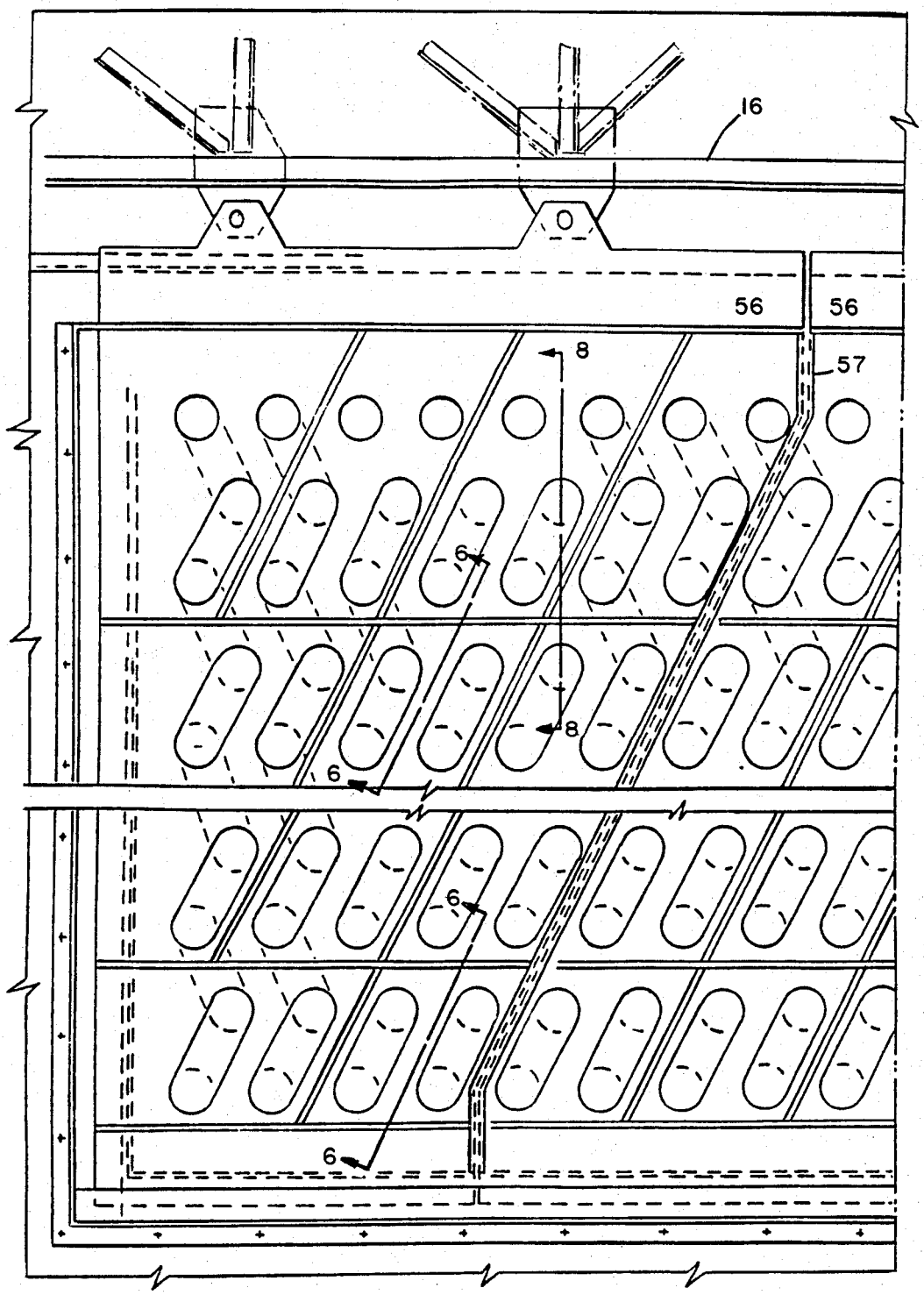
FIG. 5 is a side view of the tube sheet and return bend on the heat transfer segment taken along line 5—5 of FIG. 4.
Figure 6:
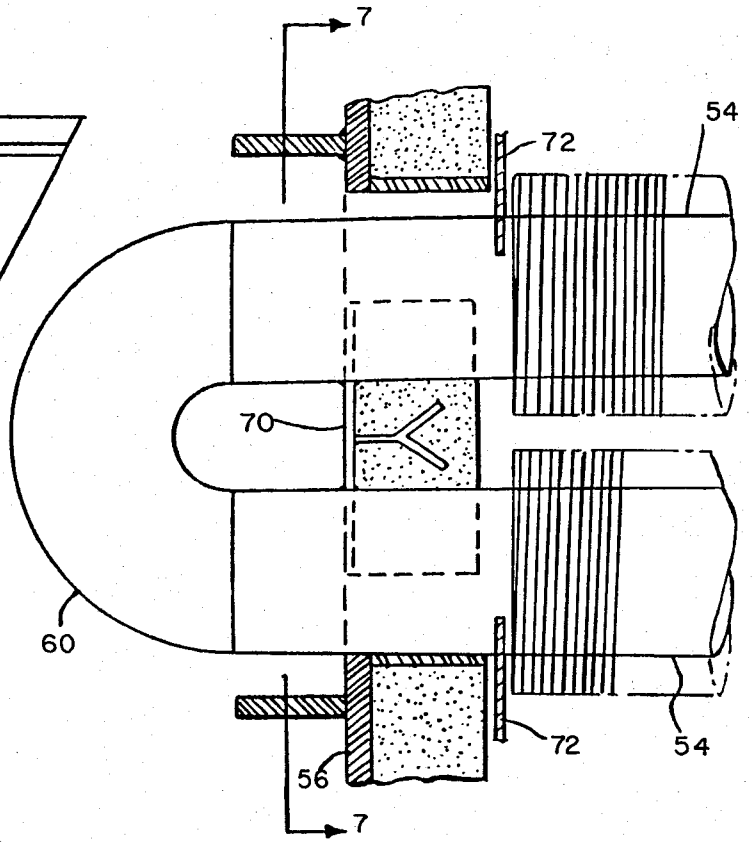
FIG. 6 is an enlarged elevational view of the tube sheet including the tubes and return bends taken along line 6—6 of FIG. 5.
Figure 7:
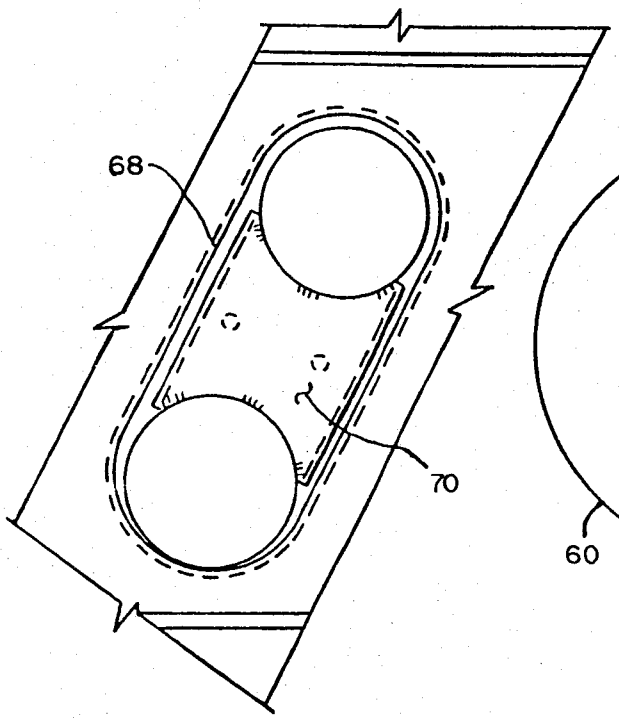
FIG. 7 is a cross-sectional view taken along the lines 7—7 of FIG. 6.
Figure 8:
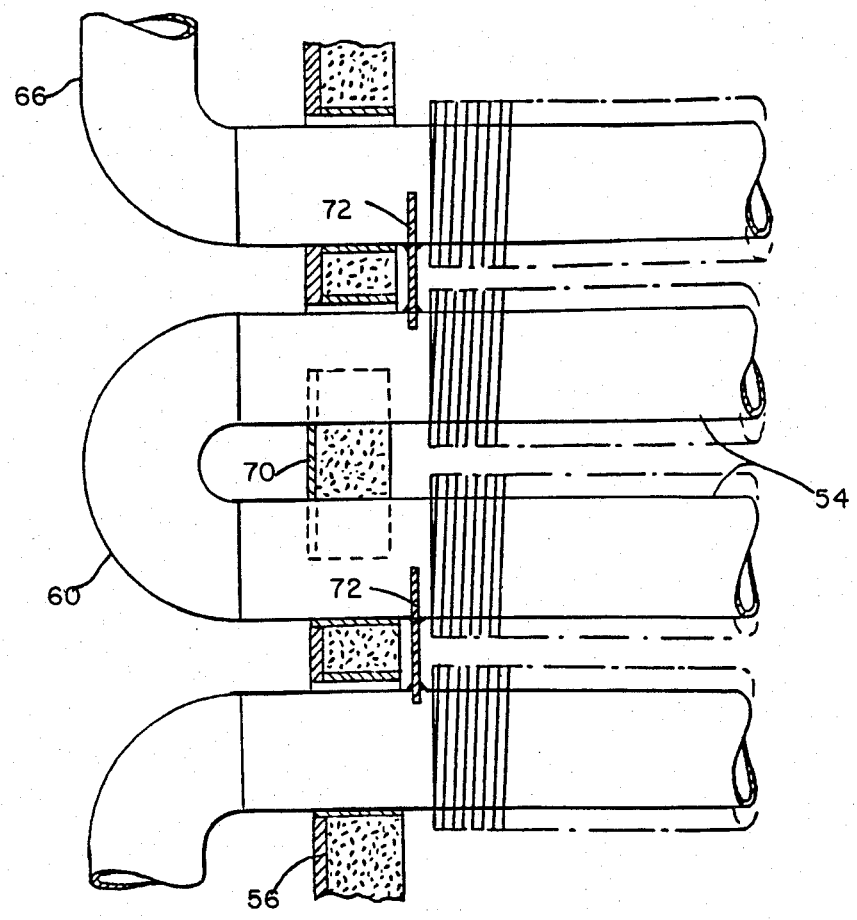
FIG. 8 is a cross-sectional view taken along the lines 8—8 of FIG. 5.

The configurations of the tube sheets 56 are shown in greater detail in FIGS. 4 to 8. By using multiple tube sheets 56, such as shown in FIGS. 2 and 5, supported by continuous support means 16, the convection section can be made as wide as necessary to accommodate the number of parallel passes required to conduct the process flow within the allowable pressure drop. The uppermost heat transfer segment 40 is in flue gas communication with stack 52. Assembly and maintenance are accomplished by making the tube sheets in sections and independently removable. The elongated opening 68 (FIG. 7) in the tube sheet between adjacent tubes is closed by seal plate 70 as shown in FIGS. 6 and 7, which seal plate is attached to the tubes 54 and can be insulated on the flue gas side in a manner similar to that employed with respect to the tube sheets. To remove the tube sheets for maintenance, temporary support for the intermediate tubes is provided by support plates 72 (FIG. 8) between tubes where a return bend is not present. It is understood that all wall and floor members and the like are provided with a suitable refractory coating material.

The tube sheets of each heat transfer segment 40 are enclosed by a plurality of cover assemblies 58. Referring now to FIG. 3, such cover assemblies comprise top, end, and bottom wall portions 82, 84, and 86 respectively, bolted to a frame member and mounted to the tube sheets and I-beam structure, thereby forming a portion of the outer wall of the convection section 20, it being understood that the cover assemblies enclose all end portions of each heat transfer segment 40.

While the heater assembly of the present invention has been described with reference to the pyrolysis of fluids, it is understood that the heat assembly of the present invention may be for any process duty as well as being applicable to other type of heater duty, e.g. power generation, where energy conservation is important. While we have described a preferred form of invention, we are aware that variations may be made thereto, and therefore, desire a broad interpretation of our invention within the scope of the disclosure herein and the following claims.

What is claimed:

1. A convection section assembly for a heater which comprises:

a plurality of vertically disposed support members; a flue means; at least two heat transfer segments mounted in vertical array, each segment comprising a pair of horizontally disposed beam support members mounted to said vertically disposed support members and located outside said flue means, the length of said members being a dimension of choice; a plurality of parallel and vertically disposed tube sheet members mounted to said beam support members and having orifices; wall means for enclosing ends of said tube sheet members; a plurality of horizontally disposed tube means including return bends for passage of a process fluid therethrough positioned within the orifices of said tube sheet members, said tube sheet members requiring no additional support means intermediate their extremities; inlet conduit means for introducing a process fluid to be heated into said tube means of said heat transfer segments; and outlet conduit means for withdrawing the heated process fluid from said tube means of said heat transfer segments.

2. The convection section assembly as defined in claim 1, wherein said process fluid is sequentially passed through said tube means of said heat transfer segments and further including conduit means for connecting tube means of one of said heat transfer segments with tube means of another one of said heat transfer segments for sequential passage of said process fluid to be heated through said plurality of heat transfer segments.

3. The convection section assembly as defined in claim 2, wherein said tube sheet members are disposed coaxially with respect to a longitudinal axis of said convection assembly.

4. The convection section assembly as defined in claim 3, further comprising a stack means for venting flue gas wherein said inlet conduit means is in fluid communication with tube means of a heat transfer segment upstream of said stack means.

5. The convection section assembly as defined in claim 4, wherein said process fluid to be heated is passed consecutively through said plurality of heat transfer segments from an uppermost heat segment to a lowermost heat transfer segment.

6. The convection section assembly as defined in claim 5, wherein a flue gas inlet is provided proximate to said lowermost heat transfer segment.

7. The convection section assembly as defined in claim 5, wherein a flue gas inlet is provided proximate said uppermost heat transfer segment.

8. The convection section assembly as defined in claim 1, wherein said openings are slots disposed at an angle to the vertical.

9. The convection section assembly as defined in claim 8, wherein said tube means include extended surfaces and said openings are formed to receive said return bends exclusive of said extended surface of said tube means.

10. The convection section assembly as defined in claim 4, wherein said heat transfer segment is in flue gas communication with said stack means via a duct member.

11. The convection section assembly as defined in claim 1, wherein said convection section assembly is rectangular and said tube means extend laterally across said convection section assembly.

12. A heater assembly for process fluids, which comprises a first plurality of vertically-disposed support members; side and end walls enclosed by top and bottom walls mounted to said vertically-disposed support members and defining a heating zone having reactant tube means; burner means for heating said reactant tube means; inlet conduit means for introducing a process fluid to be heated into said reactant tube means; outlet conduit means for withdrawing a reactant gas from said reactant tube members; a second plurality of vertically disposed support members; a flue means; at least two heat transfer segments mounted in vertical array, each segment comprising a pair of horizontally disposed beam support members mounted to said second plurality of support members and located outside said flue means, the length of said members being a dimension of choice; a plurality of parallel and vertically disposed tube sheet members mounted to said beam support members and having orifices; wall means for enclosing ends of said tube sheet members; a plurality of horizontally disposed tube means including return bends for passage of a process fluid therethrough positioned within the orifices of said tube sheet members, said tube sheet members requiring no additional support means intermediate their extremities; inlet conduit means for introducing a process fluid to be heated into said tube means of said heat transfer segments; and outlet conduit means for withdrawing the heated process fluid from said tube means of said heat transfer segments.

13. The heater assembly as defined in claim 12, wherein said process fluid is sequentially passed through said tube means of at least two of said heat transfer segments and further including conduit means for connecting tube means of one of said heat transfer segments with tube means of another one of said heat transfer segments for sequential passage of said process fluid to be heated through said plurality of heat transfer segments.

14. A convection section assembly as defined in claim 12, wherein said beam support members are refractory lined.

15. A heater assembly as defined in claim 12, wherein said beam support members are refractory lined.

* * * * *